US008177506B2

(12) United States Patent
Cunha et al.

(10) Patent No.: US 8,177,506 B2
(45) Date of Patent: May 15, 2012

(54) MICROCIRCUIT COOLING WITH AN ASPECT RATIO OF UNITY

(75) Inventors: Francisco J. Cunha, Avon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 1392 days.

(21) Appl. No.: 11/339,921

(22) Filed: Jan. 25, 2006

(65) Prior Publication Data

US 2007/0172355 A1 Jul. 26, 2007

(51) Int. Cl.
*F01D 5/08* (2006.01)

(52) U.S. Cl. ..... 416/97 R

(58) Field of Classification Search ..... None
See application file for complete search history.

(56) References Cited

U.S. PATENT DOCUMENTS

| | | | | |
|---|---|---|---|---|
| 3,849,025 | A | 11/1974 | Grondahl | |
| 5,484,258 | A | 1/1996 | Isburgh et al. | |
| 5,690,472 | A | 11/1997 | Lee | |
| 6,174,133 | B1 * | 1/2001 | Bunker | 416/97 R |
| 6,637,500 | B2 | 10/2003 | Shah et al. | |
| 2002/0164250 | A1 * | 11/2002 | Chung et al. | 416/97 R |
| 2003/0235494 | A1 * | 12/2003 | Draper | 416/97 R |

FOREIGN PATENT DOCUMENTS

| | | | |
|---|---|---|---|
| EP | 1022432 | A2 | 7/2000 |
| EP | 1375824 | A2 | 1/2004 |
| EP | 1586739 | A2 | 10/2005 |
| JP | 59160002 | A | 9/1984 |
| JP | 2003181599 | A | 7/2003 |

OTHER PUBLICATIONS

Japanese Office Action dated Aug. 11, 2009.

* cited by examiner

*Primary Examiner* — Richard Edgar
(74) *Attorney, Agent, or Firm* — Bachman & LaPointe, P.C.

(57) ABSTRACT

A turbine engine component having improved cooling is provided. The turbine engine component includes an airfoil portion having a leading edge, a trailing edge, a pressure side, a suction side, a root, and a tip, and at least one cooling circuit in a wall of the airfoil portion. The at least one cooling circuit has at least one passageway extending between the root and the tip. The at least one passageway has an aspect ratio of no greater than 2:1, and preferably substantially unity.

22 Claims, 4 Drawing Sheets

MICROCIRCUIT COOLING WITH AN ASPECT RATIO OF UNITY

BACKGROUND OF THE INVENTION (1) Field of the Invention

The present invention relates to a turbine engine component having improved cooling and a refractory metal core for forming the cooling passages.

(2) Prior Art

Rotational speeds for certain types of engines are very high as compared to large commercial turbofan engines. As a result, the main flow through the cooling circuits of turbine engine components, such as turbine blades, will be affected by secondary Coriolis forces and rotational buoyancy. The velocity profile of the main cooling flow is towards the trailing edge of the cooling passage. For a radial outward flow cooling passage with an aspect ratio of 3:1, there is a strong potential for cooling flow reversal, which in turn leads to poor heat transfer performance. Therefore, it is extremely important for cooling passages to maintain aspect ratios as close as possible to unity. This is needed to avoid main flow reversal and poor heat transfer performance.

There are existing cooling schemes currently in operation for different small engine applications. Even though the cooling technology for these designs has been very successful in the past, it has reached a culminating point in terms of durability. That is, to achieve superior cooling effectiveness, these designs have included many enhancing cooling features such as turbulating trip strips, shaped film holes, pedestals, leading edge impingement before film, and double impingement trailing edges. For these designs, the overall cooling effectiveness can be plotted in durability maps as shown in FIG. 1, where the abscissa is the overall cooling effectiveness parameter and the ordinate is the film effectiveness parameter. The plotted lines correspond to the convective efficiency values from zero to unity. The overall cooling effectiveness is the key parameter for a blade durability design. The maximum value is unity, implying that the metal temperature is as low as the coolant temperature. This is impossible to achieve. The minimum value is zero where the metal temperature is as high as the gas relative temperature. In general, for conventional cooling designs, the overall cooling effectiveness is around 0.50. The film effectiveness parameter lies between full film coverage at unity and complete film decay without film traces at zero film.

The convective efficiency is a measure of heat pick-up or performance of the blade cooling circuit. In general, for advanced cooling designs, one targets high convective efficiency. However, trades are required as a balance between the ability of heat pick-up by the cooling circuit and the coolant temperature that characterizes the film cooling protection to the blade. This trade usually favors convective efficiency increases. For advanced designs, the target is to use design film parameters and convective efficiency to obtain an overall cooling effectiveness of 0.8 or higher, as illustrated in FIG. 1. From this figure, it is noted that the film parameter has increased from 0.3 to 0.5, and the convective efficiency has increased from 0.2 to 0.6. As the overall cooling effectiveness increases from 0.5 to 0.8, this allows the cooling flow to be decreased by about 40% for the same external thermal load. This is particularly important for increasing turbine efficiency and overall cycle performance.

SUMMARY OF THE INVENTION

In accordance with the present invention, there is provided a microcircuit cooling system with cooling passages which maintain aspect ratios as close as possible to one.

There is also provided a cooling scheme that has the means to (1) increase film protection, (2) increase heat pick-up, and (3) reduce airfoil metal temperature, denoted here as the overall cooling effectiveness, all at the same time. This may be achieved through the use of refractory metal core technology.

In accordance with the present invention, a turbine engine component broadly comprises an airfoil portion having a leading edge, a trailing edge, a pressure side, a suction side, a root, and a tip and at least one cooling circuit in a wall of the airfoil portion. The at least one cooling circuit has at least one passageway extending between the root and the tip, which at least one passageway has an aspect ratio which is less than 2:1, and preferably substantially unity.

Further in accordance with the present invention, there is provided a refractory metal core for forming at least one cooling circuit within a wall portion of the airfoil portion. The refractory metal core broadly comprises a tubular portion, and the tubular portion has an aspect ratio no greater than 2:1, and preferably substantially unity.

Other details of the microcircuit cooling with an aspect ratio of unity, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
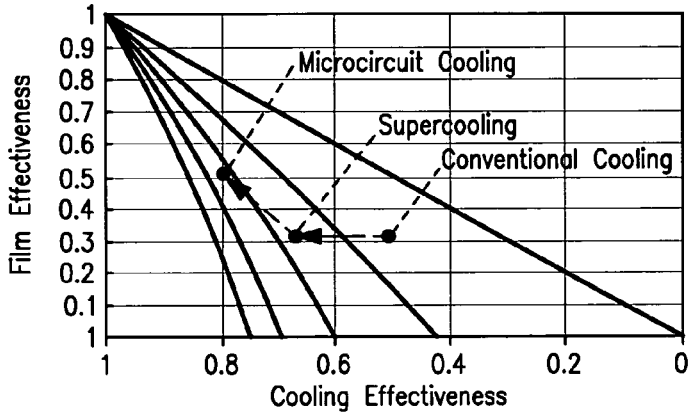
FIG. 1 is a durability map illustrating the path for higher overall cooling effectiveness from conventional to supercooling to microcircuit cooling.
Figure 2:
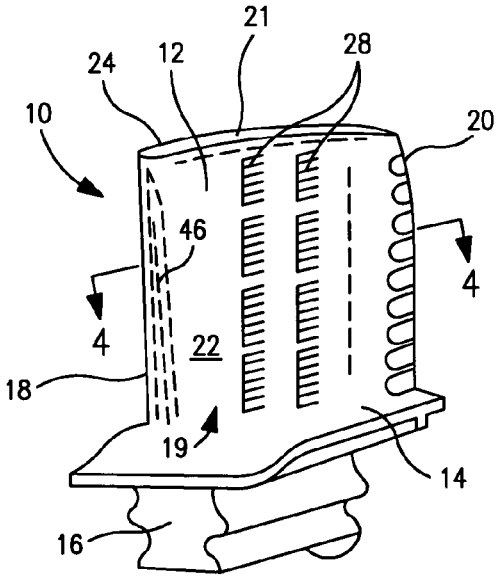
FIG. 2 illustrates a turbine engine component and the pressure side of an airfoil portion.
Figure 3:
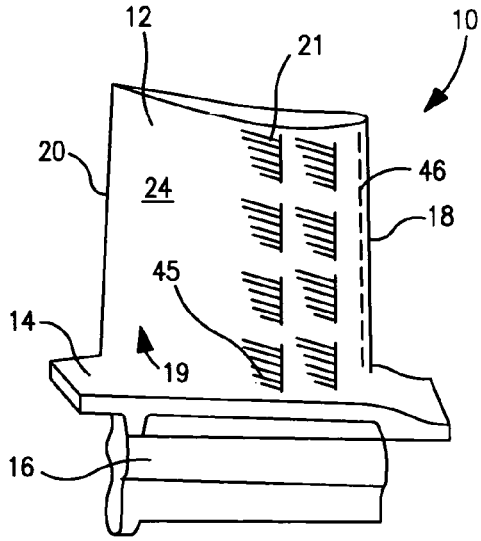
FIG. 3 illustrates the turbine engine component of FIG. 2 and the suction side of the airfoil portion.

Referring now to FIGS. 2 and 3, there is shown a turbine engine component 10, such as turbine blade or vane. The component 10 has an airfoil portion 12, a platform 14, and an attachment portion 16. The airfoil portion 12 has a leading edge 18, a trailing edge 20, a pressure side 22, a suction side 24, a root 19, and a tip 21. The turbine engine component 10 may be formed from any suitable material known in the art, such as a nickel based superalloy.

Figure 4:
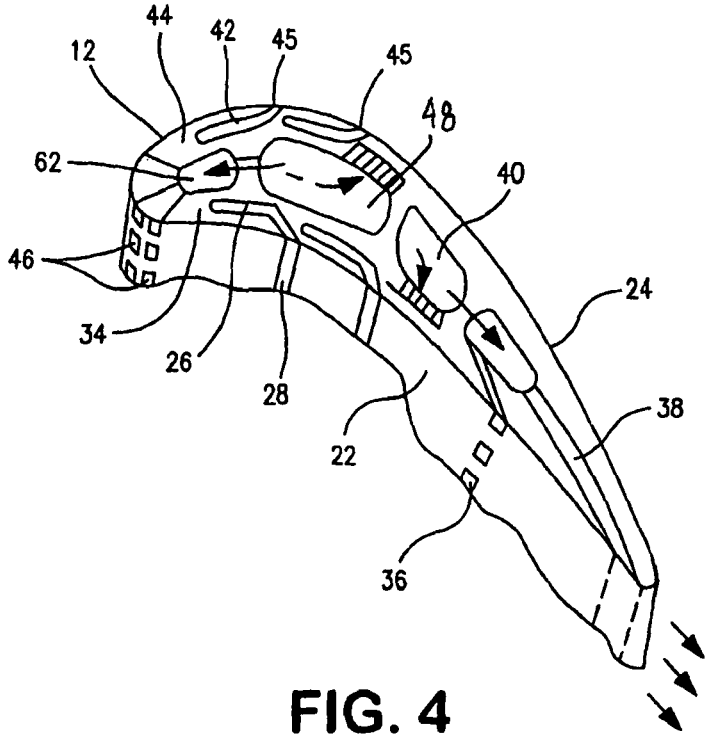
FIG. 4 is a sectional view of the airfoil portion of the turbine engine component along lines 4-4 in FIG. 2.

Referring now to FIG. 4, there is shown a cooling system for a turbine engine component 10. The cooling system includes one or more pressure side cooling circuits or passages 26 having film cooling slots 28. The cooling circuit(s) or passage(s) 26 and the film cooling slot(s) 28 associated with each circuit or passage 26 may be formed by using a refractory metal core 30 having one or more tabs 32. As can be seen from FIG. 4, the cooling circuit(s) or passage(s) 26 are preferably formed within a wall 34 of the airfoil portion. The film cooling slot(s) 28 allow cooling fluid to flow over the pressure side 22 of the airfoil portion 12. Each cooling circuit or passage 26 preferably extends between the tip 21 and the root 19 of the airfoil portion 12.

The pressure side 22 of the airfoil portion 12 also may be provided with a plurality of shaped holes 36. The holes 36 may be formed using any suitable conventional technique known in the art.

The airfoil portion 12 also may be provided with a trailing edge cooling microcircuit 38. The airfoil portion 12 may have a first supply cavity 40 for supplying cooling fluid to the trailing edge cooling microcircuit 38 and the cooling passage (s) 26.

The suction side 24 of the airfoil portion 12 may be provided with one or more cooling circuits or passages 42. The cooling circuit(s) or passage(s) 42 may be formed using refractory metal core technology and, as described hereinbelow, may have a serpentine configuration. As can be seen from FIG. 4, the cooling circuit(s) or passage(s) 42 are located within the wall 44 forming the suction side 24 of the airfoil portion 12 and extend between the tip 21 and the root 19. Each of the cooling circuits or passages 42 may have at least one cooling film slot 45 which may be formed by tab elements 32 on a refractory metal core 30.

The leading edge 18 of the airfoil portion 12 may be provided with a plurality of film cooling holes 46. The cooling holes 46 may be formed using any suitable technology known in the art. The airfoil portion 12 may have a second supply cavity 48 for providing cooling fluid to the cooling circuit(s) or passage(s) 42 and the film cooling holes 46.

Figure 5:
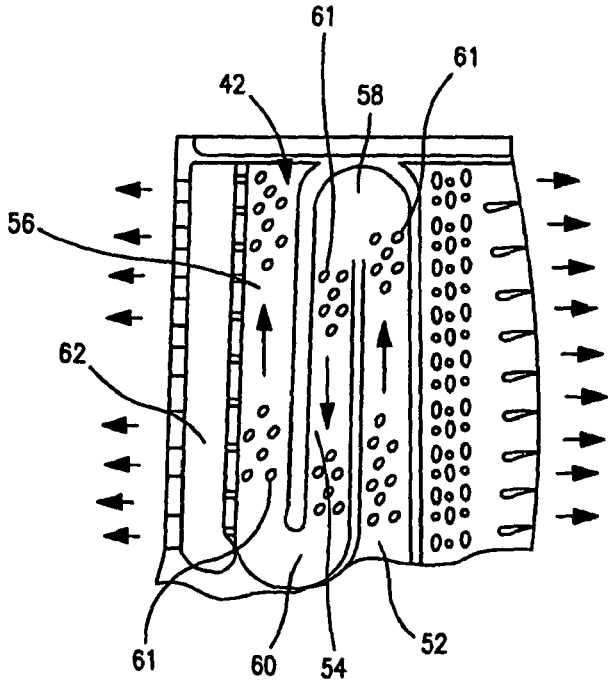
FIG. 5 is a sectional view of a cooling passage in a wall of the airfoil portion.

Referring now to FIG. 5, there is shown a serpentine configured cooling circuit or passage 42 which may be imbedded in the suction side wall 44. As shown in the figure, the cooling passage 42 may have a first leg 52 into which a cooling fluid may flow from the second supply cavity 48, an intermediate leg 54, and an outlet leg 56. The first leg 52 is connected to the intermediate leg 54 via a tip turn 58, while the intermediate leg 54 is connected to the outlet leg 56 via a root turn 60. Each of the legs 52, 54, and 56 may be provided with a plurality of pedestals 61 for increasing heat pick-up or convective efficiency.

In a preferred embodiment of the present invention, each of the legs 52, 54, and 56 has an aspect ratio of about 2:1 or less, most preferably an aspect ratio of substantially unity. As used herein, the term "aspect ratio" is the ratio of the width to the height. To accomplish this, each of the legs 52, 54, and 56 may be circular in cross section. Alternatively, each of the legs 52, 54, and 56 may be square in cross section.

The airfoil portion 12 may also include a feed cavity 62 for supplying cooling fluid to the leading edge film cooling holes 46.

As can be seen in FIG. 2, the pressure side cooling fluid film traces with high coverage from the film slots 28. As can be seen in FIG. 3, the suction side cooling fluid film also traces with high coverage from the film slots 45.

The high coverage cooling fluid film may be accomplished by means of the slots 28 and 45 which are preferably made using one or more tabs 32 on a refractory metal core 30. The heat pick-up or convective efficiency may be accomplished by peripheral cooling with many turns and pedestals 61 as heat transfer enhancing mechanisms. The overall result of high film coverage and improved ability for heat pick-up leads to a cooling technology leap of high overall cooling effectiveness or lower airfoil metal temperature. This, in turn, can be used to decrease the cooling flow or increase part service life.

The rotational speeds for small engine applications can be very high as compared to large commercial turbofans, i.e. 40,000 RPM vs. 16,000 RPM. As a result, the main flow through the cooling microcircuits may be affected by the secondary forces of Coriolis and rotational buoyancy. For rotational environments, the velocity profile of the main flow is towards the trailing edge of the cooling passage. Studies have shown that for a radial outward flowing cooling passage, there is a strong potential for cooling flow reversal in a cooling passage if the aspect ratio is about 3:1. Therefore, it is important that any cooling passages formed using refractory metal core technology maintain aspect ratios as close as possible to unity. This is to avoid main flow reversal and poor heat transfer characteristics. As a consequence, the airfoil metal temperature would be high, leading to premature oxidation, fatigue, and creep.

Figure 6:
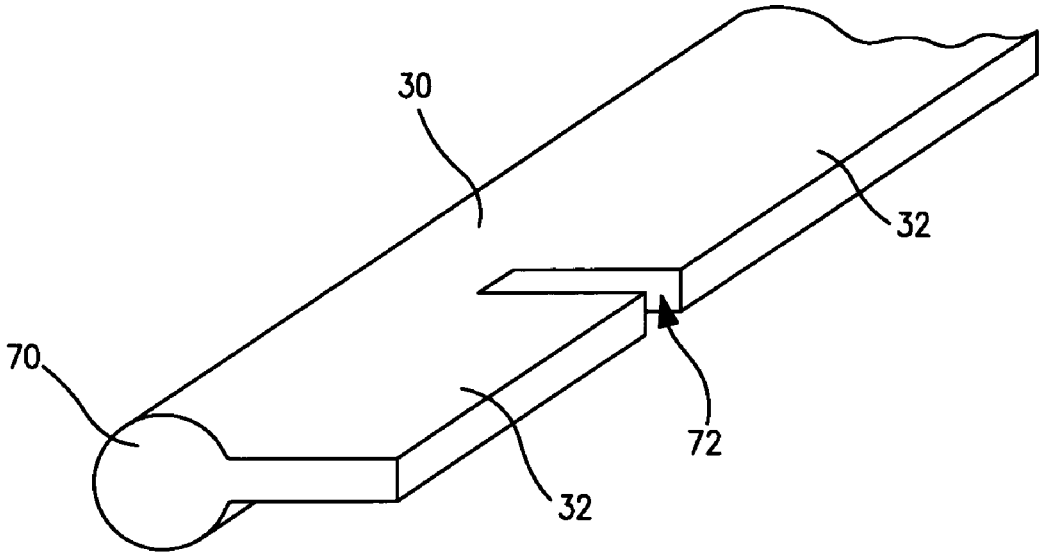
FIG. 6 illustrates a refractory metal core for forming a cooling passage having an aspect ratio of approximately unity.
Figure 7:
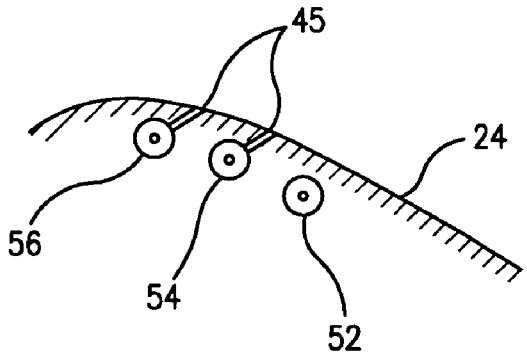
FIG. 7 illustrates a cooling passage formed by the refractory metal core of FIG. 6.
Figure 8:
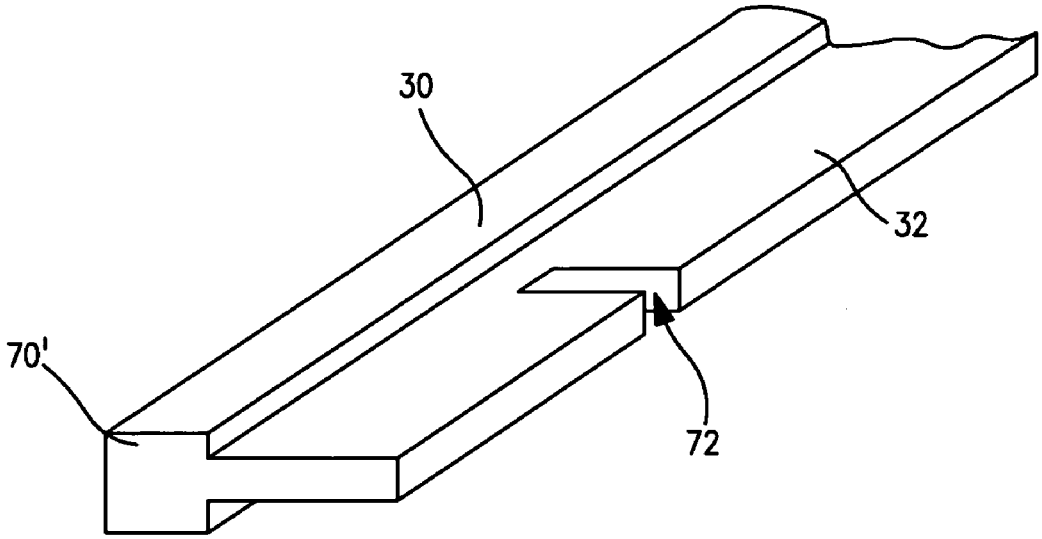
FIG. 8 illustrates an alternative refractory metal core for forming a cooling passage having an aspect ratio of approximately unity.
Figure 9:
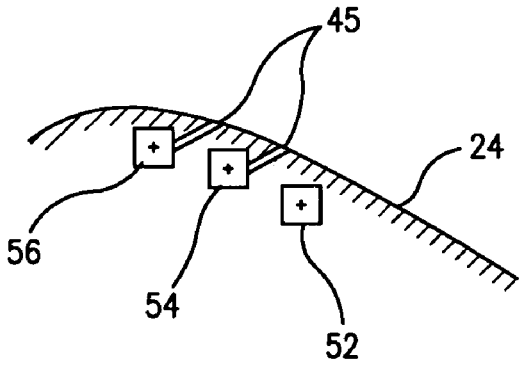
FIG. 9 illustrates a cooling passage formed by the refractory metal core of FIG. 8.

As noted above, the various legs 52, 54, and 56 of the cooling circuit or passageway 42 may be formed using a refractory metal core 30. The refractory metal core 30 may have a serpentine shape that corresponds to the desired shape of the passageway 42. When a serpentine shaped refractory metal core is used, the refractory metal core 30 may have three tubular portions 70 that form the legs 52, 54, and 56. As shown in FIG. 6, each of the tubular portions 70 may have a circular cross section. Alternatively, as shown in FIG. 8, the tubular portion 70' may have a square cross section. The use of a circular cross section, or a square cross section, tubular portion achieves a leg in the cooling passageway having an aspect ratio close to unity. The refractory metal core portions 70 that form the legs 54 and 56 may have one or more tab elements 32 that ultimately form the cooling film slots 45. When the refractory metal core portion 70 has more than two tabs elements 32, the tab elements 32 may be spaced apart by a notch 72. This results in spaced apart cooling film slots 45. FIG. 7 illustrates a cooling circuit or passageway 42 wherein the legs 52, 54, and 56 have a circular cross. FIG. 9 illustrates a cooling circuit or passageway 42 wherein the legs 52, 54, and 56 each have a square cross section.

The refractory metal core 30 may be formed from any suitable refractory metal material known in the art. For example, the refractory metal core 30 may be formed from molybdenum or a molybdenum alloy.

The foregoing refractory metal core technology shown in FIGS. 6 and 8 could also be used to form the cooling circuit or passages 26 in the pressure side wall 34. The refractory metal core portion 70, with either the circular or square cross section as shown in FIGS. 6 and 8, could form the cooling circuits or passages 26. The tab elements 32 integrally formed with the portion 70 can be bent to form the slots 28.

The passageways 42 and 26 and the cooling film slots 45 and cooling passages 26 may be formed by placing the refractory metal cores 30 within the die and securing them in place with wax. Silica core elements may be placed in the die to form the supply cavities 40 and 48 as well as any other central core cavities in the airfoil portion 12. After the core elements have been positioned, molten metal is introduced into the die and allowed to solidify to form the walls and external surfaces of the airfoil portion 12. After the walls and external surfaces are formed, the silica core elements and the refractory core elements are removed. The silica core elements and the refractory core elements may be removed using any suitable technique known in the art. The pedestals 61 may be formed, using any suitable technique known in the art, after the cooling passageways 26 and 42 have been formed.

Microcircuit cooling systems in accordance with the present invention increases overall cooling effectiveness. As the overall cooling effectiveness increases from 0.5 to 0.8, it allows for cooling flow reduction by about 40% for the same external thermal load as conventional designs. This is particularly important for increasing turbine efficiency and overall cycle performance. The cooling systems have the means to increase film protection and heat pick-up, while reducing the metal temperature. This is denoted herein as the overall cooling effectiveness, all at the same time.

It is apparent that there has been provided in accordance with the present invention a microcircuit cooling with an aspect ratio of unity which fully satisfies the objects, means, and advantages set forth hereinbefore. While the present invention has been described in the context of specific embodiments thereof, other unforeseeable alternatives, modifications, and variations will become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a leading edge, a trailing edge, a pressure side, a suction side, a pressure side wall, a suction side wall, a root, and a tip; and at least one cooling circuit in at least one of said pressure side wall and said suction side wall of said airfoil portion;

said at least one cooling circuit having a serpentine configuration with a plurality of interconnected passageways extending between said root and said tip; and each of said passageways having an aspect ratio no greater than 2:1 for preventing cooling flow reversal in each of said passageways, wherein said aspect ratio for each said passageway is a ratio of a width of a respective passageway to a height of said respective passageway.

2. The turbine engine component according to claim 1, wherein said aspect ratio is substantially unity.

3. The turbine engine component according to claim 1, wherein each said passageway is substantially circular in cross section.

4. The turbine engine component according to claim 1, wherein each said passageway is substantially square in cross section.

5. The turbine engine component according to claim 1, wherein said at least one cooling circuit is located in said suction side wall.

6. The turbine engine component according to claim 1, wherein said at least one cooling circuit is located in said pressure side wall.

7. The turbine engine component according to claim 1, further comprising at least one additional cooling circuit having a serpentine configuration with a plurality of interconnected passageways in one of said suction side and pressure side walls, and each of said cooling circuits having a plurality of cooling film slots associated therewith for distributing cooling fluid over an exterior surface of at least one of said suction side wall and said pressure side wall of said airfoil portion.

8. The turbine engine component according to claim 7, further comprising a trailing edge cooling microcircuit.

9. The turbine engine component according to claim 8, further comprising a supply cavity for supplying cooling fluid to said at least one additional cooling circuit and said trailing edge microcircuit.

10. The turbine engine component according to claim 1, further comprising a plurality of cooling holes in the leading edge of said airfoil portion.

11. The turbine engine component according to claim 10, wherein a supply cavity supplies cooling fluid to said leading edge cooling holes and said at least one cooling circuit.

12. The turbine engine component according to claim 1, further comprising said at least one cooling circuit having means for increasing heat pick-up.

13. The turbine engine component according to claim 12, wherein said heat pick-up increasing means comprises a plurality of pedestals in said at least one cooling circuit.

14. A turbine engine component comprising:

an airfoil portion having a leading edge, a trailing edge, a pressure side, a suction side, a pressure side wall, a suction side wall, a root, and a tip;

at least one cooling circuit in at least one of said pressure side wall and said suction side wall of said airfoil portion;

said at least one cooling circuit having a serpentine configuration with a plurality of interconnected passageways extending between said root and said tip;

each of said passageways having an aspect ratio no greater than 2:1 for preventing cooling flow reversal in each of said passageways; and at least two of said passageways having a plurality of cooling slots integrally formed therewith.

15. A refractory metal core for forming a passageway within a wall of an airfoil portion of a turbine engine component, said refractory metal core comprising a tubular portion, and said tubular portion having an aspect ratio no greater than 2:1, wherein said aspect ratio is a ratio of a width of said tubular portion to a height of said tubular portion.

16. The refractory metal core according to claim 15, wherein said aspect ratio is substantially unity.

17. The refractory metal core according to claim 15, wherein said tubular portion has a circular cross section.

18. The refractory metal core according to claim 15, wherein said tubular portion has a square cross section.

19. The refractory metal core according to claim 15, further comprising a plurality of tab elements extending from a single side of said tubular portion.

20. The refractory metal core according to claim 15, wherein said metal core has a plurality of interconnected tubular portions arranged in a serpentine configuration and each of said tubular portions has an aspect ratio no greater than 2:1.

21. A refractory metal core for forming a passageway within a wall of an airfoil portion of a turbine engine component, said refractory metal core comprising a tubular portion, said tubular portion having an aspect ratio no greater than 2:1, wherein said aspect ratio is a ratio of a width of said tubular portion to a height of said tubular portion, and a plurality of integrally formed tab elements attached to said tubular portion.

22. The refractory metal core according to claim 21, wherein adjacent ones of said integrally formed tab elements are spaced apart by a notch.

* * * * *